US005381715A

United States Patent [19]

Spercel

[11] Patent Number: 5,381,715

[45] Date of Patent: Jan. 17, 1995

[54] TUNING DEVICE

[76] Inventor: Robert J. Spercel, Marine Tower-East, Unit 1503, 12520 Edgewater Dr., Lakewood, Ohio 44107

[21] Appl. No.: 43,186

[22] Filed: Apr. 6, 1993

[51] Int. Cl.[6] ..... G10D 3/14

[52] U.S. Cl. ..... 84/304

[58] Field of Search ..... 84/304, 305, 306, 297 R, 84/200-208, 312 R

[56] References Cited

U.S. PATENT DOCUMENTS

| | | | |
|---|---|---|---|
| 542,157 | 7/1895 | Gosse | 84/306 |
| 1,443,486 | 1/1923 | Lindstrom | 84/306 |
| 3,830,132 | 8/1974 | Lowe | 84/304 |
| 4,213,370 | 7/1980 | Jones | 84/306 |
| 4,625,614 | 12/1986 | Spercel | 84/306 |
| 5,097,736 | 3/1992 | Turner | 84/304 |
| 5,277,095 | 1/1994 | Steinberger | 84/304 |

FOREIGN PATENT DOCUMENTS

| | | |
|---|---|---|
| 22701 | 7/1909 | United Kingdom . |
| 231064 | 3/1925 | United Kingdom . |

*Primary Examiner*—Michael L. Gellner
*Assistant Examiner*—Cassandra C. Spyrou
*Attorney, Agent, or Firm*—Tarolli, Sundheim & Covell

[57] ABSTRACT

An improved device for tuning a string of a musical instrument includes a string post which is axially movable relative to a housing. A clamp assembly inside the string post grips a portion of the string. The string post is then moved axially to tension the string. A single tuning knob is utilized to perform the dual functions of actuating the clamp assembly to grip the string and moving the string post axially to tension the gripped string. When the tuning knob is in an extended position, a socket type clutch interconnects the tuning knob and a clamp screw. Rotation of the extended tuning knob rotates the clamp screw to grip the string. When the tuning knob is in a retracted position, the clutch between the tuning knob and the clamp screw is disengaged and a drive connection between the tuning knob and the string post is engaged. Rotation of the retracted tuning knob causes the drive connection to move the string post axially to tension the string.

10 Claims, 4 Drawing Sheets

TUNING DEVICE

BACKGROUND OF THE INVENTION

The present invention relates to a new and improved device for tuning a string of a musical instrument.

A known device for tuning a string of a musical instrument is disclosed in U.S. Pat. No. 4,625,614. The tuning device disclosed in this patent includes a string post having an opening at one end to receive a string. To tune the string, a worm and pinion are manually actuated to rotate the string post. A passage extends axially through the pinion and at least part way through the string post. A clamp is provided in the passage to grip the string. This enables the string to be tuned by turning the string post.

SUMMARY OF THE INVENTION

The present invention provides an improved device for tuning a string of a musical instrument. The device includes a string post which is partially disposed in a housing and has a passage to receive the string. A gripper grips the string. A drive system is provided to move the string post axially to tension the string. An actuator is provided to operate the gripper to grip the string and to operate the drive system to move the string post axially to tension the string.

BRIEF DESCRIPTION OF THE DRAWINGS

The foregoing and other features of the invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
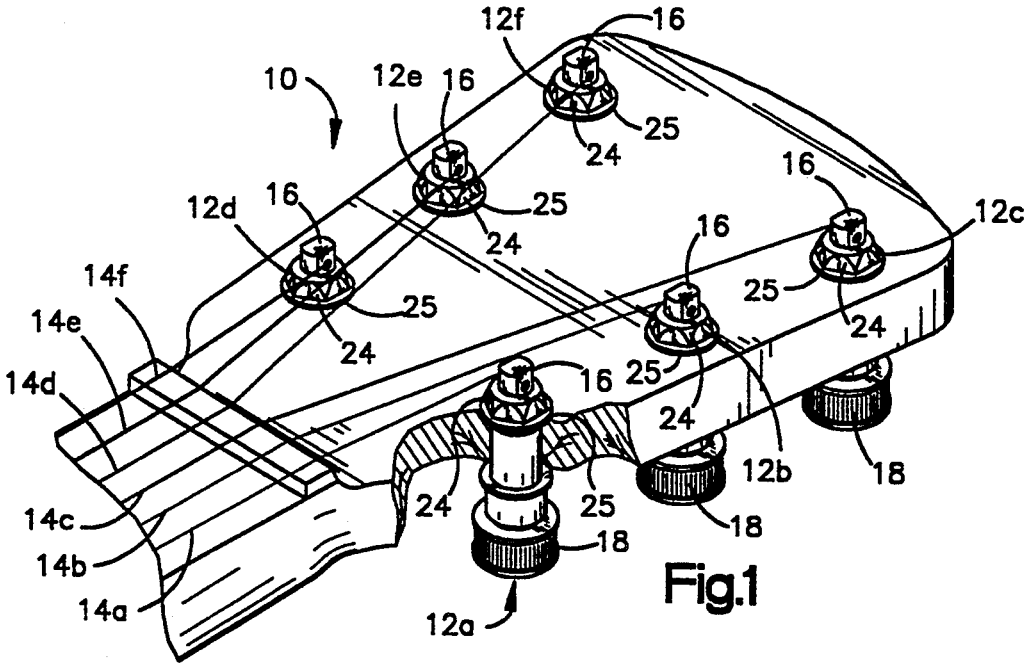
FIG. 1 is a partially broken away schematic illustration of the head portion of a musical instrument having string tuning devices constructed in accordance with the present invention.

The head portion 10 of a stringed musical instrument, such as a guitar, includes a plurality of identical tuning devices 12*a–f* (FIG. 1). A plurality of strings 14*a–f* extend from the body of the instrument (not shown) to the head 10, where each string is attached to a string post 16 of a tuning device 12. Each string 14 of the instrument may be tuned by rotating a tuning knob 18 of the associated tuning device 12. Rotating a tuning knob

18 of a tuning device 12 varies the tension in the associated string 14 to tune the string.

The tuning device 12 (FIG. 2) includes a housing 20. The housing 20 encloses the string post 16. The housing 20 clamps against opposite sides of the head 10 (FIG. 1) of the musical instrument to mount the tuning device 12 on the head of the musical instrument. The housing 20 includes a generally hexagonal mounting cap 24 (FIG. 2) which clamps a washer 25 (FIG. 1) against the upper side of the head 10. The housing 20 also includes a cylindrical body section 26 having a hexagonal flange 28 which engages a lower side of the head 10.

The string post 16 has a cylindrical string passage or opening 32 through which a string 14 extends. The string post 16 is movable axially relative to the housing 20 to vary the tension in a string 14 which extends through the string passage 32. Thus, to increase the tension in a string 14, the string post 16 is moved axially downwardly (as viewed in FIG. 2) into the housing 20. During this axial movement of the string post 16, the string post is held against rotation. As the string post 16 moves axially downward, the string engages the mounting cap 24 and is tensioned with a pulling action.

Figure 4:
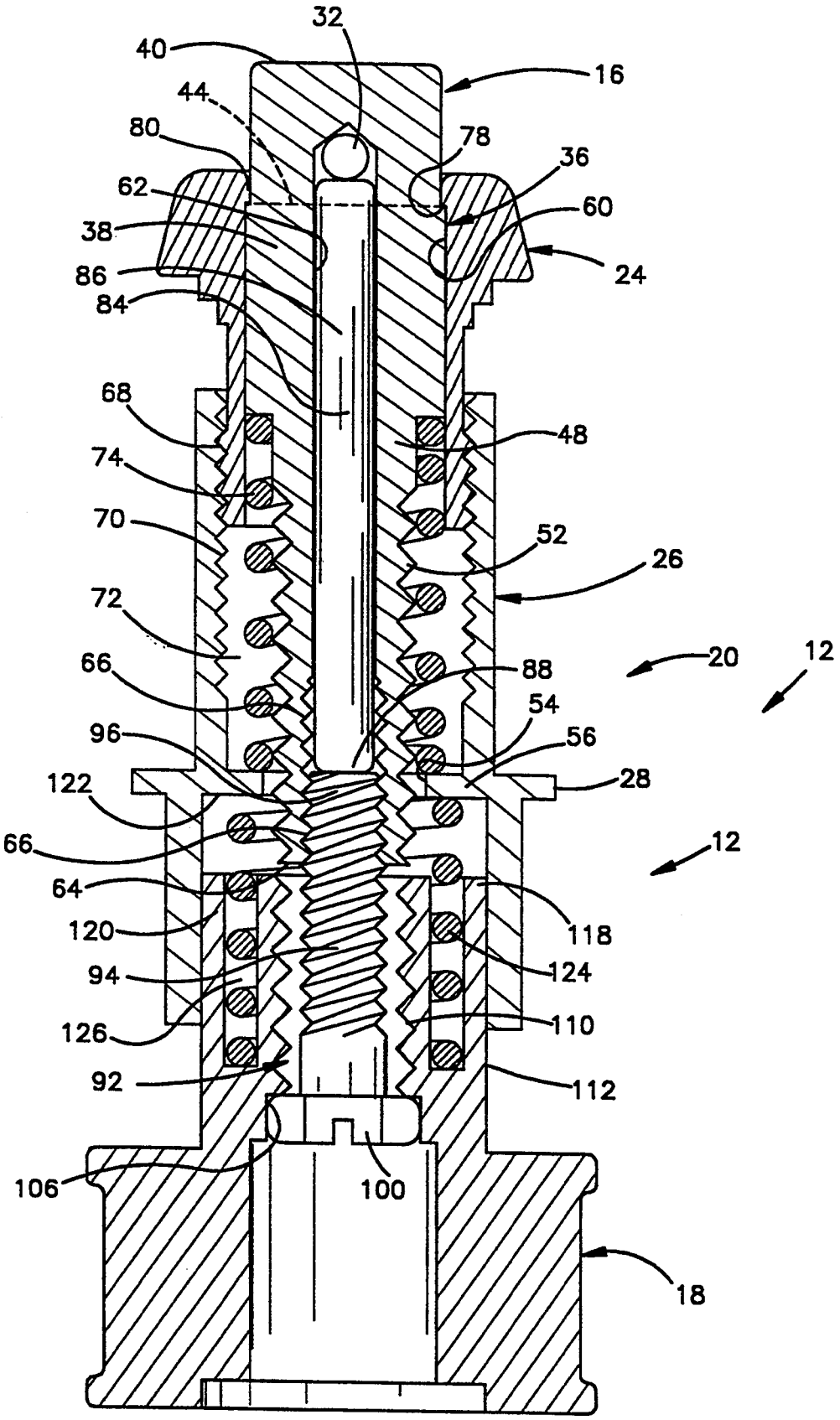
FIG. 4 is a sectional view illustrating the relationship between the components of the tuning device of FIG. 1, the tuning device being shown with a tuning knob in an extended position in which rotation of the tuning knob operates a gripper assembly to hold a string against movement relative to a string post.
Figure 5:
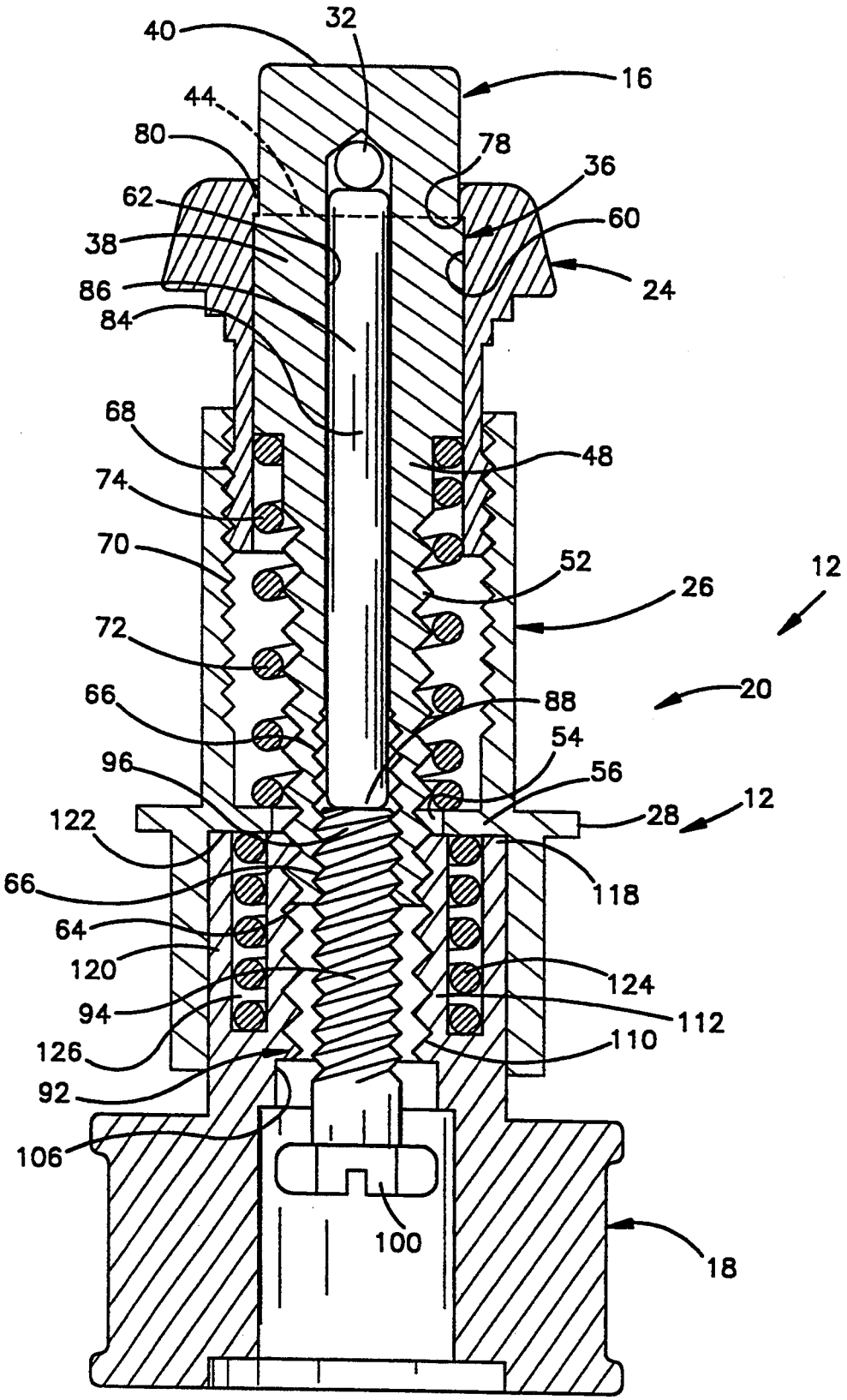
FIG. 5 is a sectional view, generally similar to FIG. 4, illustrating the tuning knob in a retracted position in which rotation of the tuning knob operates a drive system to move the string post axially to tension the string.

The tuning knob 18 is rotatable and axially movable relative to the housing 20. The tuning knob 18 is movable between an extended position (FIG. 4) and a retracted position (FIG. 5). When the tuning knob 18 is in the extended position (FIG. 4) rotation of the tuning knob clamps the string 14 in the string passage 32 to grip the string and hold it against movement relative to the string post 16. When the tuning knob 18 is in the retracted position (FIG. 5), rotation of the tuning knob 18 moves the string post 16 axially to increase the tension in the gripped string.

Tuning Device

The string post 16 is enclosed by the housing 20. The string post 16 receives a string 14 and is moved axially relative to the housing 20 to tension the string. The string post 16 includes a head end portion 36 (FIGS. 3 and 4) having a cylindrical main section 38 and an upwardly (as viewed in FIGS. 3 and 4) extending end portion 40.

Figure 2:
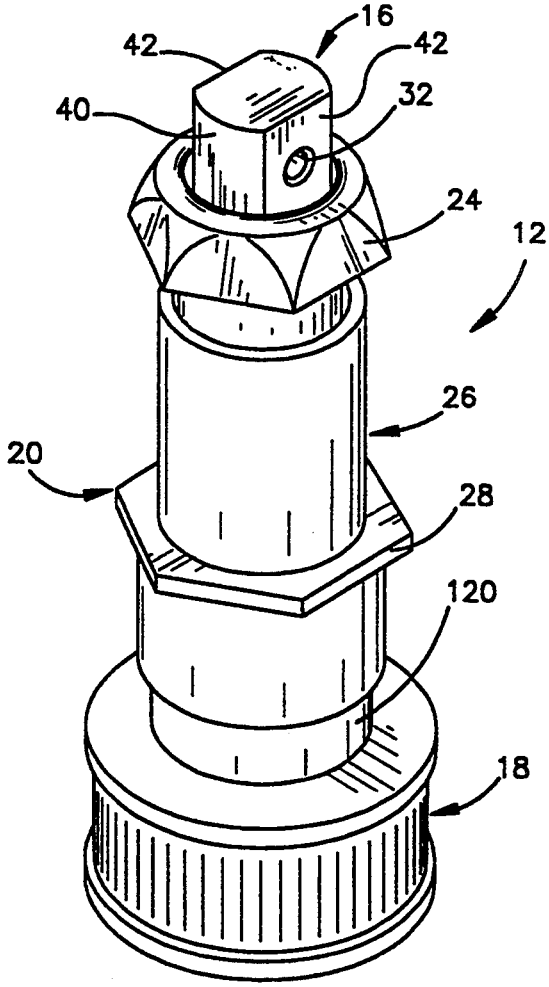
FIG. 2 is an enlarged pictorial illustration of one of the string tuning devices of FIG. 1.

The end portion 40 of the string post 16 is coaxial with and extends axially upwardly from the main section 38. The end portion 40 has a somewhat smaller diameter than the main section 38. The end portion 40 has a pair of flat parallel side surfaces 42 (FIG. 2). The cylindrical string passage 32 extends between and is perpendicular to the flat side surfaces 42. An annular flat end surface 44 is formed on the main section 38 of the head end portion 36 and faces upwardly (as viewed in FIG. 4) away from the tuning knob 18.

Figure 3:
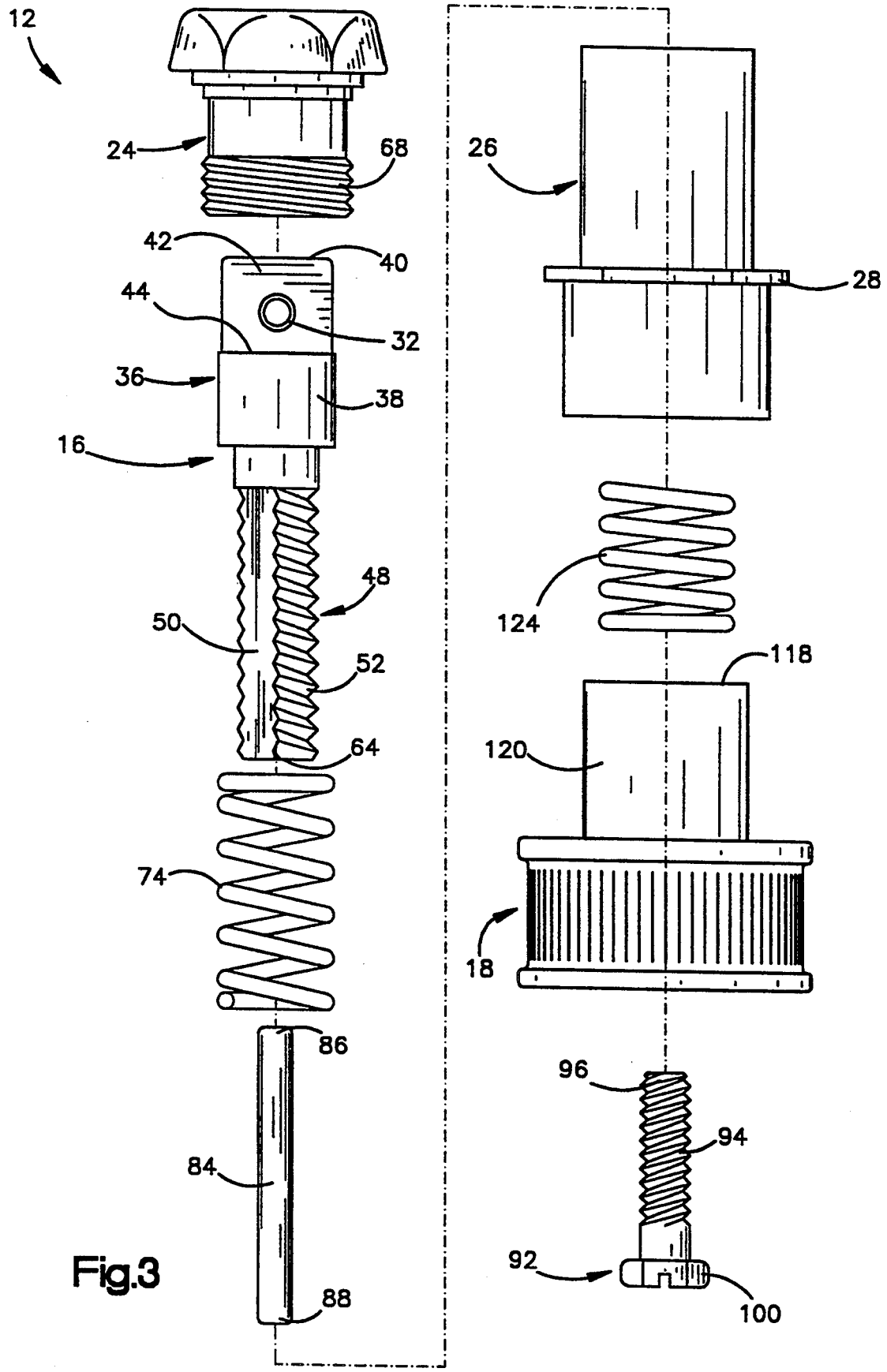
FIG. 3 is an exploded illustration of the components of the tuning device of FIG. 2.

The string post 16 (FIG. 3) has a shank section 48 which has a generally cylindrical configuration. The shank section 48 is coaxial with the main section 38 of the head end portion 36. The shank section 48 has a single flat side surface 50 and external threads 52 (FIGS. 3 and 4). The shank section 48 extends through an opening 54 formed in an internal flange 56 in the body section 26 of the housing 20 (FIG. 4).

The opening 54 (FIG. 4) has a generally D-shaped configuration with an arcuate side surface which is a portion of a circle and a flat side surface which interconnects opposite ends of the arcuate side surface. The flat side surface of the opening 54 engages the flat side surface 50 (FIG. 3) on the string post 16 to hold the string post against rotation relative to the housing 20.

Although the opening 54 cooperates with the flat side surface 50 on the string post 16 to hold the string post against rotation, the string post 16 is freely movable axially relative to the opening 54. The cylindrical main section 38 of the string post 16 cooperates with a cylindrical inner side surface 60 (FIG. 4) of the mounting cap 24 to guide axial movement of the string post 16 relative to the housing 20.

A central passage 62 (FIG. 4) extends axially from a lower end portion 64 of the string post 16 to an intersection with the string passage 32. The cylindrical central passage 62 has a longitudinal central axis which is coincident with a central axis of the string post 16 and which intersects the central axis of the string passage 32. The longitudinal axis of the central passage 62 extends perpendicular to the central axis of the string passage 32. Internal threads 66 are formed in the lower (as viewed in FIG. 4) portion of the central passage 62.

The mounting cap 24 (FIGS. 3 and 4) has external threads 68 which engage internal threads 70 (FIG. 4) on the body section 26 to interconnect the mounting cap and body section. A spring chamber 72 is formed between the internal flange 56 on the body section 26 and the main section 38 of the head end portion 36 of the string post 16. The cylindrical spring chamber 72 receives a helical string post spring 74 (FIGS. 3 and 4). The string post spring 74 is coaxial with the string post 16 and housing 20. The string post spring 74 extends around the shank section 48 of the string post 16 and presses the annular end surface 44 on the main section 38 of the head end portion 36 against an annular inwardly facing end surface 78 (FIG. 4) formed on an annular radially extending flange 80 of the mounting cap 24.

Abutting engagement between the end surface 44 on the main section 38 of the head end portion 36 of the string post 16 and the end surface 78 on the mounting cap flange 80 positions the string post 16 axially relative to the mounting cap 24. The string post spring 78 presses the upwardly facing end surface 44 on the main section 38 of the string post 16 against the downwardly facing end surface 78 on the mounting cap flange 80. The string post 16 is positioned relative to the mounting cap 24 with the lower side of the string passage 32 tangential to a plane containing an upper side of the mounting cap flange 80. If desired, the string passage 32 could be located so that it is a few thousandths of an inch below (as viewed in FIG. 4) or inward of the plane containing the upper side of the mounting cap flange 80.

A clamp pin 84 (FIGS. 3 and 4) is disposed in the central passage 62 and clamps the portion of a string 14 disposed in the string passage 32 against the inside of the string post 16 to firmly grip the string. The cylindrical clamp pin 84 is disposed in a coaxial relationship with the string post 16 and central passage 62. An upper end portion 86 of the clamp pin 84 is movable into the string passage 32 to engage the lower side of a string. The upper end portion 86 of the clamp pin presses against the string to clamp the string against the upper side of the string passage 32. A slight indentation is formed in the upper side of the string passage and cooperates with the upper end portion 86 of the clamp pin 84 to securely and firmly grip a string 14 in the manner described in the aforementioned U.S. Pat. No. 4,625,614.

The axial extent of the clamp pin 84 (FIG. 4) is less than the axial extent of the central passage 62 in the string post 16. Therefore, a lower end portion 88 of the clamp pin 84 is disposed in the string passage 62. The internal threads 66 in the central passage 62 extend upwardly past the lower end portion 88 of the clamp pin 84 for a plurality of turns. The upper portion of the central passage 62 has a cylindrical side surface which is unthreaded and engages the clamp pin 84 to position and guide axial movement of the clamp pin.

A clamp pin screw 92 (FIGS. 3 and 4) presses against the lower end portion 88 of the clamp pin 84 to press the upper end portion 86 of the clamp pin against a string 14 in the string passage 32. The clamp pin screw 92 has an externally threaded shank portion 94. The externally threaded shank portion 94 engages the internal threads 66 (FIG. 4) in the central passage 62.

An upper end portion 96 of the screw shank 94 is disposed in abutting engagement with the lower end portion 88 of the clamp pin 84. Therefore, upon rotation of the clamp pin screw 92 relative to the string post 16, the interaction between the external threads on the shank portion 94 and the internal threads 66 of the central passage 62 causes the clamp pin screw 92 to press the clamp pin 84 upwardly (as viewed in FIG. 4). This presses the upper end portion 86 of the clamp pin 84 against the lower side of a string 14 in the string passage 32. The string 14 is firmly clamped between the upper end 86 of the clamp pin 84 and an upper side of the string passage 32.

The clamp pin screw 92 functions as an actuator for a gripper formed by the clamp pin screw, clamp pin 84 and side surface of the string passage 32. The clamp pin screw 92 has a hexagonal head end portion 100 (FIGS. 3 and 4). The head end portion 100 of the clamp pin screw 92 is disposed in a coaxial relationship with the shank portion 94 and the clamp pin 84.

The tuning knob 18 tightens the clamp pin screw 92 against the clamp pin 84 to grip a string 14 between the upper end portion 86 of the clamp pin and an inner side surface of the string passage 32. In addition, the tuning knob 18 pulls the string post 16 axially downwardly (as viewed in FIGS. 4 and 5) relative to the housing 20 to tighten the string 14 after the string has been gripped between the clamp pin 84 and the side surface of the string passage 32.

When the tuning knob 18 is in the extended position of FIG. 4, rotation of the tuning knob about its central axis and the central axis of the string post 16 is effective to rotate the clamp pin screw 92 relative to the string post. When the tuning knob 18 is in the retracted position of FIG. 5, rotation of the tuning knob relative to the string post 16 is effective to pull the string post axially downwardly relative to the housing 20 to tension a string gripped by the clamp pin 84.

When the tuning knob is in the extended position of FIG. 4, a hexagonal socket 106 engages the hexagonal head portion 100 of the clamp screw 92. The hexagonal socket 106 is fixedly secured to and formed as one piece with the tuning knob 18. Therefore, upon rotation of the tuning knob 18 about its central axis, the socket 106 rotates the head end portion 100 of the clamp pin screw 92.

Rotation of the head end portion 100 of the clamp pin screw 92 results in the external threads on the shank portion 94 of the clamp pin screw interacting with the internal threads 66 in the central passage 62 to effect either upward or downward movement of the clamp pin 84, depending upon the direction of rotation of the clamp pin screw 92. The socket 106 and head end portion 100 of the clamp pin screw 92 function as a clutch which is engaged when the tuning knob 18 is in the extended position of FIG. 4. At this time, the clutch is effective to transmit force between the tuning knob 18 and the clamp pin screw 92.

When the tuning knob 18 is moved axially upwardly from the extended position of FIG. 4 to the retracted position of FIG. 5, the socket 106 is disengaged from the head end portion 100 of the clamp pin screw 92. At this time, the clutch is disengaged. Rotation of the tuning knob 18 is then ineffective to rotate the clamp pin screw 92.

When the tuning knob 18 is in the retracted position (FIG. 5), internal threads 110 on a cylindrical wall 112 inside the tuning knob 18 engage external threads 52 on the outside of the string post 16. The internal threads 110 and external threads 52 are disposed in a coaxial relationship with the tuning knob 18 and string post 16.

Rotation of the tuning knob 18 through three of four revolutions moves an annular upper end portion 118 of a cylindrical outer wall 120 of the tuning knob 18 into abutting engagement with flat annular downwardly facing side surface 122 on the internal housing flange 56. Continued rotation of the tuning knob 18 causes the internal threads 110 connected with the tuning knob and the external threads 52 on the outside of the string post 16 to function as a drive system which pulls the string post 16 downward against the influence of the string post string 74.

As the string post 16 moves axially downwardly, the flat outer side surface 50 on the string post 16 cooperates with the D-shaped opening 54 to retain the string post 16 against rotation relative to the housing 20. During axially downward movement of the string post 16 relative to the housing 20, the string 14 is gripped between the clamp pin 84 and the inner side surface of the string passage 32 and is pulled downwardly. The string slides across the circular upper side surface on the flange 80 of the mounting cap 24 and is pulled downwardly to tension the string. Since the string post 16 does not rotate, the string is tensioned with a straight pulling action which facilitates obtaining and subsequently maintaining the desired tension in the string.

As the string post 16 is pulled downwardly, against the influence of the string post spring 74, by the interaction between the external threads 52 on the string post and the internal threads 110 connected with the tuning knob 18, the annular end surface 44 on the string post head end portion 36 moves downwardly away from the annular end surface 78 on the mounting cap 24. The interaction between the internal threads 110 connected with the tuning knob 18 and the external threads 52 on the string post 16 holds the string post 16 in the desired position.

The internal threads 110 connected with the tuning knob 18 and the external threads 52 on the string post 16 function as a drive system. This drive system transmits force between the tuning knob 18 and string post 16 to pull the string post 16 axially downwardly (as viewed in FIGS. 4 and 5) against the influence of the string post spring 74. As the string post 16 is pulled downward by the drive system, a string 14 clamped between the upper end portion 86 of the clamp pin 84 and the side surface of the string passage 32 is pulled downward.

A tuning knob spring 124 is disposed in an annular spring chamber 126. The spring chamber 126 is formed between the cylindrical outer wall 120 of the tuning knob 18 and the cylindrical inner wall 112 on which the internal threads 110 are formed. The helical tuning knob spring 124 urges the tuning knob 18 to the extended position of FIG. 4 when the internal threads 110 connected with the tuning knob are disengaged from the external threads 52 on the string post.

The string post spring 74 is stronger than the tuning knob spring 124. Therefore, when the internal threads 110 connected with the tuning knob 18 engage the external threads 52 on the outside of the string post 16, the string post is held in the position shown in FIG. 4 by the string post spring 74. When the tuning knob 18 has been turned through a sufficient number of revolutions to cause the upper end portion 118 of the cylindrical wall 120 to press against the internal flange 56 on the housing body section 26, the string post 16 is pulled downwardly against the influence of the relatively strong string post spring 74 by subsequent rotation of the tuning knob. As this occurs, the end surface 44 on the main section 38 of the string post 16 moves downwardly away from the end surface 78 formed on the mounting cap flange 80.

Operation

When a guitar string 14 is to be tightened, it is inserted into the string passage 32. After the string 14 has been manually pulled taut to provide an initial tension in the string, the tuning knob 18 is rotated with the tuning knob in the extended position of FIG. 4. At this time, the socket 106 engages the head end portion 100 of the clamp pin screw 92.

Rotation of the tuning knob 18 is in a direction so that the interaction between the external threads on the shank 94 of the clamp pin screw 92 and the internal threads 66 in the central passage 62 in the string post 16 causes the clamp pin screw to press against the lower end portion 88 of the clamp pin 84. This force is transmitted through the clamp pin 84 and is applied against the lower side of a string 14 in the string passage 32 by the upper end portion 86 of the clamp pin. This results in the string 14 being firmly and securely gripped between the clamp pin 84 and the inner side surface of the string passage 32.

After the string has been clamped by rotation of the tuning knob 18 in the extended position of FIG. 4, the tuning knob 18 is moved axially upwardly from the extended position of FIG. 4 to the retracted position of FIG. 5. As this occurs, the socket 106 moves out of engagement with the head end portion 100 of the clamp screw 92. This disengages the clutch between the clamp screw 92 and the tuning knob 18.

Immediately thereafter, continued upward movement of the tuning knob moves internal thread convolution 110 on the inside of the tuning knob 18 into abutting engagement with the external thread convolution 52 on the outside of the string post 16. Rotation of the tuning knob 18 then interconnects the internal and external threads 110 and 52 to interconnect an axial drive system between the string post 16 and tuning knob 18.

After the tuning knob 18 has been rotated through three or four revolutions, the upper end portion 118 of the cylindrical outer wall 120 of the tuning knob moves into abutting engagement with the internal flange 56 on the housing body section 26. At this time, the head end portion 36 of the string post 16 is held in abutting engagement with the flange 80 on the mounting cap 24 by the relatively strong string post spring 74.

Continued rotation of the tuning knob 18 pulls the string post 16 axially downwardly (as viewed in FIGS. 4 and 5) to tighten the string 14 which is clamped in the string passage 32. During this rotation of the tuning knob 18, the string post 16 is held against rotation by the interaction between the D-shaped opening 54 in the housing and the flat 50 on the string post. Therefore, the string post 32 is pulled straight axially downwardly into the housing 20 by rotation of the tuning knob 18. As the string post 16 moves downwardly into the housing 20, the head end portion 36 of the string post moves away from the flange 80. As this occurs, the string is pulled downwardly across the circular upper side surface of the flange 80 into the housing 20 to tension the spring.

In order to release a string 14 or reduce the tension in the string, the direction of rotation of the tuning knob 18 is reversed. If the reverse direction of rotation of the tuning knob 18 is continued through a sufficient number of revolutions, the string post 16 is moved back upwardly into engagement with the flange 80 on the mounting cap 24. Continued rotation of the tuning knob 18 results in disengagement of the internal threads 110 on the cylindrical wall 112 connected with the tuning knob from the external threads 52 on the string post 16. When this occurs, the drive system between the tuning knob 18 and the string post 16 is disengaged.

Upon disengagement of the drive system between the tuning knob 18 and string post 16, the tuning knob spring 124 moves the tuning knob 18 downwardly to the extended position of FIG. 4. As this occurs, the socket 106 engages the head end portion 100 of the clamp pin screw 92 to re-engage the clutch between the tuning knob 18 and clamp screw pin 92. Subsequent rotation of the tuning knob in the reverse direction results in the clamp pin screw 92 moving axially downwardly to release the clamp pin 84. This interrupts the gripping action between the clamp pin 84 and the portion of the string 14 disposed in the string passage 32 so that the string can be withdrawn from the tuning device 12.

Second Embodiment

Figure 6:
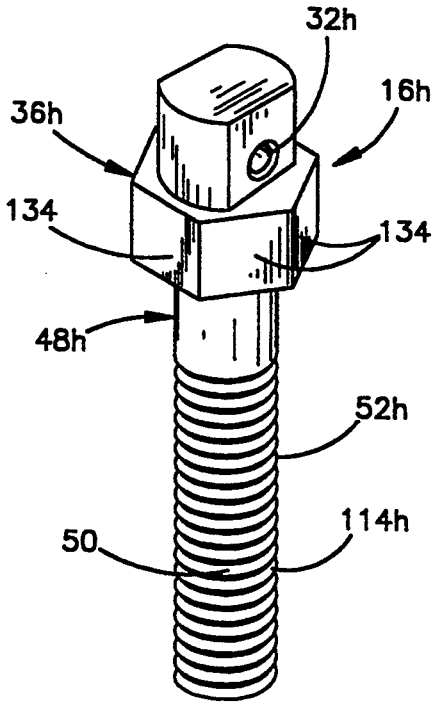
FIG. 6 (on sheet 1 of the drawings) is a pictorial illustration of a second embodiment of the string post.

In the embodiment of the invention illustrated in FIGS. 1–5, the string post 16 is formed with a flat side surface 50 which cooperates with the D-shaped opening 54 to retain the string post against rotation relative to the housing 20. In the embodiment of the invention illustrated in FIG. 6, the head end portion of the string post has a generally hexagonal configuration and cooperates with the mounting cap to hold the string post against rotation relative to the housing. Since the embodiment of the invention illustrated in FIG. 6 is generally similar to the embodiment of the invention illustrated in FIGS. 1–5, similar numerals will be utilized to designate similar components, the suffix letter "h" being associated with the numerals of FIG. 6 to avoid confusion.

A string post **16*h* has a head end portion 36*h* with a string passage 32*h*. A cylindrical shank 48*h* extends axially downwardly (as viewed in FIG. 6) from the head end portion 36*h*. An external thread convolution 52*h* is formed on the cylindrical shank 48*h***.

In accordance with a feature of this embodiment of the invention, the head end portion **36*h* includes a plurality of flat side surfaces 134 which are disposed in a hexagonal array about the head end portion 36*h*. The flat side surfaces 134 on the head end portion 36*h* of the string post 16*h* engage surfaces formed on the inside of a mounting cap (not shown) of a tuning device housing to hold the string post 16*h*** against rotation relative to the housing.

Since the string post **16*h* is held against rotation relative to the housing by the flats 134, the thread convolution 52*h* is a continuous thread convolution. The shank portion 48*h* of the string post 16*h* is free of a flat corresponding to the flat 50 on the string post 16 (FIGS. 3 and 4). Since the external threads 52*h* (FIG. 6**) are not interrupted by the presence of a flat, it is believed it may be easier to engage and disengage the internal threads connected with the tuning knob from the thread convolution.

It should be understood that although only the string post **16*h* has been shown in FIG. 6, the string post is a component of a tuning device having the same general construction as the tuning device 12 of FIGS. 1–5. Thus, the string post 16*h* is enclosed within a housing corresponding to the housing 20 of FIGS. 4 and 5. The string post 16*h* has a central passage, corresponding to the central passage 62 of FIGS. 4 and 5, to receive a clamp pin, corresponding to the clamp pin 84**.

Conclusion

The present invention provides an improved device 12 for tuning a string 14 of a musical instrument. The device 12 includes a string post 16 which is partially disposed in a housing 20 and has a passage 32 to receive the string 14. A gripper formed by the clamp pin 84 and inner side surface of the string passage 32, grips the string 14. A drive system, formed by threads 110 and 52, is provided to move the string post 16 axially relative to the housing 20 to tension the string 14. An actuator 18 is provided to operate the gripper to grip the string 14 and to operate the drive system to move the string post 16 axially relative to the housing 20.

Having described the invention, the following is claimed:

1. A device for tuning a string of a musical instrument, said device comprising a housing, a string post at least partially disposed in said housing and having a string passage to receive a portion of the string, gripper means connected with the string post for gripping the string, drive means for moving said string post axially relative to said housing to tension the string while the string is gripped by said gripper means, and actuator means for operating said gripper means to grip the string and for operating said drive means to move said string post axially relative to said housing while the string is gripped by said gripper means, said actuator means includes a single manually engageable member which is movable relative to said housing to operate said gripper means and is movable relative to said housing to operate said drive means.

2. A device as set forth in claim 1 wherein said manually engageable member is rotatable about a central axis of said manually engageable member and is axially movable along the central axis of said manually engageable member between a first position and a second position, said manually engageable member being rotatable relative to said string post to operate said gripper means to grip the portion of the string disposed in the string passage in said string post when said manually engageable member is in the first position, said manually engageable member being rotatable relative to said string post to operate said drive means to move said string post axially relative to said housing when said manually engageable member is in the second position.

3. A device as set forth in claim 1 wherein said actuator means includes clutch means for connecting said manually engageable member with said gripper means and for disconnecting said manually engageable member from said gripper means, said manually engageable member being manually rotatable to operate said gripper means when said manually engageable member is connected with said gripper means by said clutch means, said manually engageable member being ineffective to operate said drive means when said manually engageable member is connected with said gripper means by said clutch means, said manually engageable member being manually rotatable to operate said drive means when said manually engageable member is disconnected from said gripper means by said clutch means, said manually engageable member being ineffective to operate said gripper means when said manually engageable member is disconnected from said gripper means by said clutch means.

4. A device as set forth in claim 1 wherein said drive means including an external thread convolution formed on said string post and an internal thread convolution connected with said manually engageable member, said manually engageable member being movable between a first position and a second position, said manually engageable member being rotatable relative to said string post to operate said gripper means to grip the portion of the string disposed in the string passage in said string post when said manually engageable member is in the first position, said internal and external thread convolutions being spaced apart when said manually engageable member is in the first position, said manually engageable member being rotatable relative to said string post to move said string post axially relative to said housing when said manually engageable member is in the second position, said internal and external thread convolutions being disposed in engagement when said manually engageable member is in the second position to enable force to be transmitted from said manually rotatable member to said string post through said internal and external thread convolutions.

5. A device as set forth in claim 4 further including spring means for urging said manually engageable member toward the first position.

6. A device as set forth in claim 1 wherein said housing includes means for defining a first stop surface facing toward said actuator means, said string post including a second stop surface which faces away from said actuator means, said device further including spring means for urging said second stop surface into abutting engagement with said first stop surface, said drive means being operable to move said string post relative to said housing and to move said second stop surface away from said first stop surface against the influence of said spring means.

7. A device for tuning a string of a musical instrument, said device comprising a housing, a string post at least partially disposed in said housing, said string post including first surface means for defining a string passage which receives a portion of the string and extends through said string post in a direction transverse to a central axis of said string post, said string post including second surface means for defining a second passage which is disposed in said string post and extends axially from an intersection with said first passage to a second end portion of said string post, said second passage having an internally threaded portion, a clamp member disposed in said second passage for engaging the string at the intersection of said string passage and said second passage, a screw having an externally threaded shank disposed in engagement with said internally threaded portion of said second passage and a head end portion connected with said shank, said head end portion of said screw being rotatable in a first direction relative to said string post to increase the extent of engagement of the externally threaded shank of said screw with said internally threaded portion of said second passage to press said clamp member against the string at the intersection of said string passage and said second passage, said head end portion of said screw being rotatable in a second direction relative to said string post to decrease the extent of engagement of the externally threaded shank of said screw with said internally threaded portion of said second passage to decrease pressure applied by said clamp member against the string at the intersection of said string passage and said second passage, an external thread convolution connected with the second end portion of said string post, a rotatable tuning knob, an internal thread convolution connected with said tuning knob and engageable with said external thread convolution, and a socket connected with and rotatable with said tuning knob, said socket being engageable with said head end portion of said screw, said tuning knob being movable between a first position and a second position, said socket being disposed in engagement with said head end portion of said screw when said tuning knob is in the first position, said internal thread convolution being disengaged from and axially spaced from said external thread convolution when said tuning knob is in the first position, said socket being disengaged from and axially spaced from said head end portion of said screw when said tuning knob is in the second position, said internal thread convolution being disposed in engagement with said external thread convolution when said tuning knob is in the second position.

8. A device as set forth in claim 7 further including a spring circumscribing said internal and external thread convolutions and a portion of said screw, said tuning knob being urged toward the first position by said spring.

9. A device as set forth in claim 7 wherein said tuning knob is rotatable about a longitudinal axis of said string post and is movable along the longitudinal axis of said string post between the first and second positions.

10. A device as set forth in claim 7 wherein said clamp member is a cylindrical pin which is disposed in said second passage, said pin having first end surface means for engaging the string at the intersection of said string passage and second passage and second end surface means for engaging an end of said shank of said screw.

* * * * *